US008651653B2

(12) United States Patent
Condello et al.

(10) Patent No.: US 8,651,653 B2
(45) Date of Patent: Feb. 18, 2014

(54) APPARATUS AND METHOD FOR APPLYING RELEASE FLUID TO A LEVELER IN A PRINTING APPARATUS

(75) Inventors: Anthony S. Condello, Webster, NY (US); Bryan J. Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 262 days.

(21) Appl. No.: 13/193,163

(22) Filed: Jul. 28, 2011

(65) Prior Publication Data

US 2013/0025485 A1 Jan. 31, 2013

(51) Int. Cl.

| | |
|---|---|
| ***B41J 2/01*** | (2006.01) |
| ***B41J 2/06*** | (2006.01) |
| ***B41F 31/00*** | (2006.01) |
| ***B41F 33/00*** | (2006.01) |

(52) U.S. Cl.
USPC ..... 347/102; 347/55; 101/335; 101/483

(58) Field of Classification Search
None
See application file for complete search history.

(56) References Cited

U.S. PATENT DOCUMENTS

| | | | | |
|---|---|---|---|---|
| 2004/0169699 | A1* | 9/2004 | Hunter et al. | 347/54 |
| 2007/0070108 | A1* | 3/2007 | Mantell et al. | 347/19 |
| 2007/0182800 | A1* | 8/2007 | Fioravanti et al. | 347/103 |
| 2010/0073410 | A1* | 3/2010 | Yui et al. | 347/6 |
| 2010/0177151 | A1* | 7/2010 | Thompson et al. | 347/102 |

* cited by examiner

*Primary Examiner* — Stephen Meier
*Assistant Examiner* — Alexander C Witkowski
(74) *Attorney, Agent, or Firm* — Ronald E. Prass, Jr.; Prass LLP

(57) ABSTRACT

An apparatus and method apply release fluid to a leveler in a printing apparatus. The apparatus can include a substrate path, at least one release fluid spray nozzle, and a marking material leveling system having a marking material leveler. The method can include transporting a substrate with marking material along the substrate path. The method can include pulse spraying release fluid to the marking material leveling system using the at least one release fluid spray nozzle to apply the release fluid to the marking material leveler. The method can include leveling marking material on the substrate using the marking material leveler with release fluid.

15 Claims, 3 Drawing Sheets

APPARATUS AND METHOD FOR APPLYING RELEASE FLUID TO A LEVELER IN A PRINTING APPARATUS

RELATED APPLICATIONS

This application is related to the application Ser. No. 13/193,045 entitled "Apparatus and Method for Applying Release Fluid to a Leveler in a Printing Apparatus," which is filed on the same date as the present application, which is commonly assigned to the assignee of the present application, and which is incorporated herein by reference in its entirety.

BACKGROUND

Disclosed herein is an apparatus and method that applies release fluid to a leveler in a printing apparatus.

Presently, wax based phase change inks, otherwise known as solid inks, and radiation curable gel inks, such as ultraviolet inks, can be jetted directly onto a media web or cut sheet media in printing devices using ink jet direct marking technology. For solid inks, after ink has been deposited on a media sheet, the ink must be leveled by a leveler. The leveler includes a potentially heated leveler roll which holds a sacrificial release fluid that in turn contacts the ink on the media. A backing pressure roll supplies nip pressure in order to spread the ink. In order to prevent ink on the media sheets from offsetting to the leveler roll, the leveler roll must maintain a uniform layer of a sacrificial release fluid, usually a silicone oil, to avoid intimate contact between the ink and bare leveling surface. In the case of radiation curable inks, a sacrificial release fluid is also used, but unlike the case of solid ink where a more viscous oil is used, radiation curable inks have been shown to perform well with water based fluids containing small amounts of polymers and/or surfactants along with other various additives. The resulting viscosity of the release fluids used with radiation curable inks is substantially less than the fluids typically used with solid ink and are in fact close to the viscosity of water.

Contact leveling may be an integrated part of an ultraviolet gel ink printing system. As discussed, the contact leveler is essentially a pair of rollers, much like a fuser roll/pressure roll configuration used in xerographic processes, which is required to spread the ink prior to final radiation cure. Much like a fuser, the leveling roll needs to have surface characteristics that inhibit the ink from adhering to, and remaining at least partially adhered to the leveling roll as the media leaves the nip. This process of having cohesive failure within the ink and leaving potions of the image behind and adhered to the leveling roll is typically referred to as offsetting.

Since the radiation curable ink typically is using water based released fluids, an analogy can be made to fountain solutions that are used in lithographic printing processes In lithographic printing, a device is used to deliver a controlled and metered amount of fluid from a sump, through the roll train where the film is continually split and eventually to the imaging plate surface in a uniform layer. This roll train, commonly referred to as a dampening system, is both expensive and requires a high degree of skill to setup and maintain. Furthermore, it is also difficult to adjust fluid delivery rates while running the damping system. This is an issue in radiation curable inks, because there is a need to account for desired changes due to media carry-out rates, contamination of rolls, different inks, different ink amounts related to digital imaging, etc. Unlike the lithographic process, radiation curable leveling requires a uniform layer across the entire roll to avoid intimate contact between the ink and the entire leveling surface. Digital printing by nature has shorter run lengths and therefore setup times become more relevant. Furthermore, newspaper machines use a roll train that is sprayed with a water solution. However, these machines continuously apply the solution to the roll train, which would apply excessive fluid for other applications.

Additionally, in cut sheet operations some damping systems or related release agent management systems start out with a large amount of film on the rolls, which can lead to the first few sheets having too much release agent resulting in inconsistent output across the media run. Again, since digital print runs are short, this becomes a quality issue as well.

Thus, there is a need for an improved apparatus and method that applies release fluid to a leveler in a printing apparatus.

SUMMARY

An apparatus and method that applies release fluid to a leveler in a printing apparatus is disclosed. The apparatus can include a substrate path, at least one release fluid spray nozzle, and a marking material leveling system having a marking material leveler. The method can include transporting a substrate with marking material along the substrate path. The method can include pulsed spraying of release fluid to the marking material leveling system using the at least one release fluid spray nozzle to apply the release fluid to the marking material leveler. The method can include leveling marking material on the substrate using the marking material leveler with release fluid.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

The embodiments include a method of applying release fluid to a leveler in an apparatus having a substrate path, at least one release fluid spray nozzle, and a marking material leveling system having a marking material leveler. The method can include transporting a substrate with marking material along the substrate path. The method can include pulsed spraying release fluid to the marking material leveling system using the at least one release fluid spray nozzle to apply the release fluid to the marking material leveler. The method can include leveling marking material on the substrate using the marking material leveler with release fluid.

The embodiments further include an apparatus for applying release fluid to a leveler in a printing apparatus. The apparatus can include a substrate path that transports a substrate with marking material on the substrate. The apparatus can include a marking material leveling system having a marking material leveler that levels marking material on the substrate. The apparatus can include at least one release fluid spray nozzle that sprays release fluid to the marking material leveling system to apply the release fluid to the marking material leveler. The marking material leveling system can level marking material on the substrate using the marking material leveler with release fluid.

The embodiments further include a method of applying release fluid to a leveler in an apparatus having a substrate path, at least one release fluid spray nozzle, and a radiation curable ink leveling system having a radiation curable ink leveler. The method can include transporting a substrate with radiation curable ink along the substrate path. The method can include periodically spraying release fluid to the radiation curable ink leveling system using the at least one release fluid spray nozzle to uniformly distribute the release fluid on the radiation curable ink leveler. The method can include leveling radiation curable ink on the substrate using the radiation curable ink leveler with release fluid.

Figure 1:
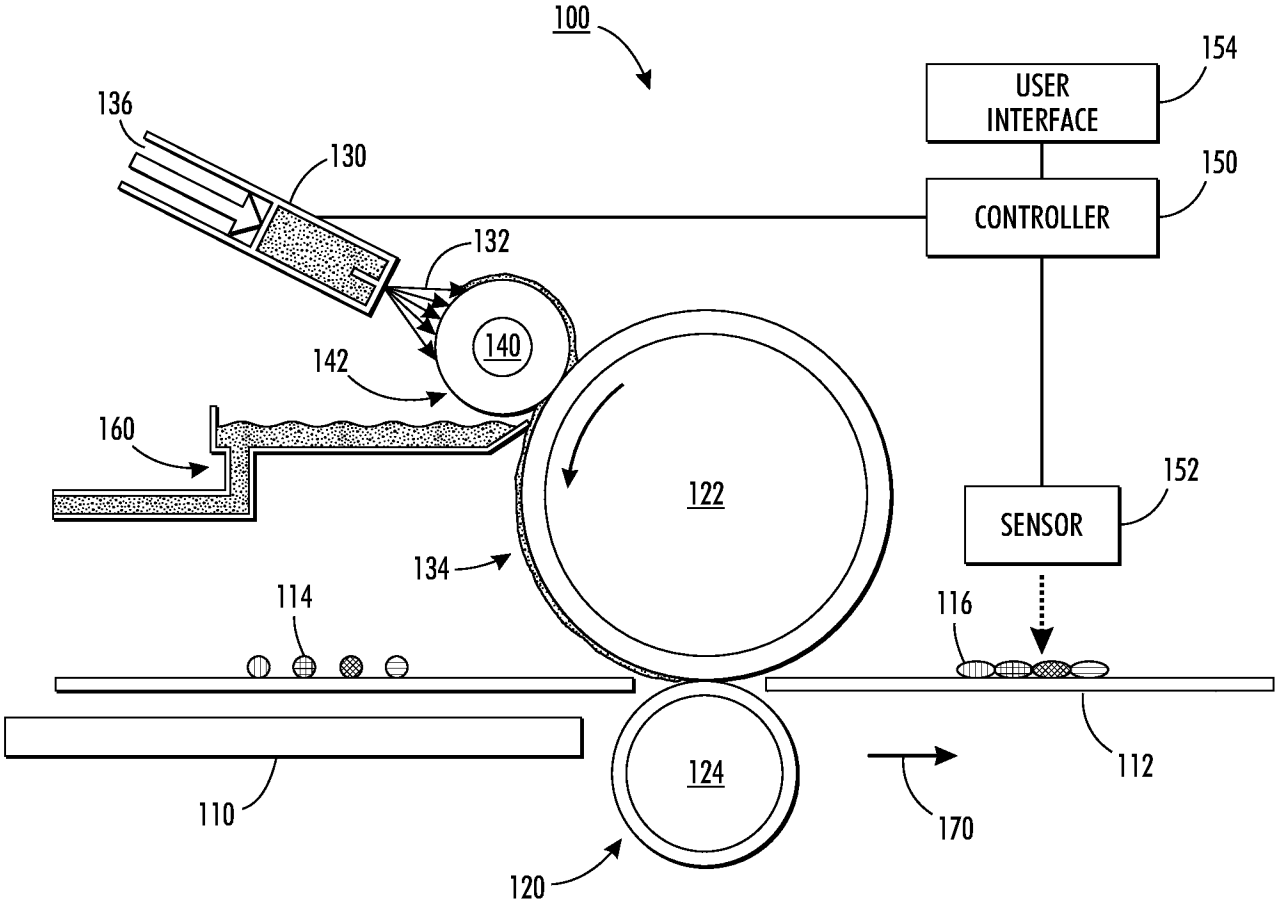
FIG. 1 is an example illustration of an apparatus according to one possible embodiment.

FIG. 1 is an example illustration of an apparatus 100 that can be used with a radiation curable ink printing apparatus according to one possible embodiment. The apparatus 100 may also be part of a printer, a multifunction media device, or any other device that generates an image on media. The apparatus 100 can include a substrate path 110 that transports a substrate 112 with marking material 114 on the substrate 112. The marking material 114 can be radiation curable ink, such as ultraviolet curable ink, or other marking material. The apparatus 100 can include a marking material leveling system 120 having a marking material leveler 122 that levels marking material 114 on the substrate 112. The marking material leveler 122 can be a roll or a belt. The marking material leveling system 120 can also include another roll or belt 124 that operates with the marking material leveler 122. The apparatus 100 can include at least one release fluid spray nozzle 130 that sprays release fluid 132 to the marking material leveling system 120 to apply the release fluid 132 to the marking material leveler 122. According to one embodiment, an orifice size of the nozzle 130 can be less than 100-200 μm.

A pressure and on/off solenoid valve 136 can be used to control application rates. The solenoid valve 136 can change the rate and duration of pulses of release fluid 132. "Pulsing" release fluid comprises spraying the release fluid on and off at regular, periodic, and/or designated intervals. Prior release fluid application devices could not use pulse spray release fluid because they did not use spray nozzles and did not use a water based release fluid that could be used with spray nozzles. Water based fluid was only applied using a roll train in lithographic printing. The release fluid 132 can be provided at a pressure of 20-50 psi, 10-100 psi, or more. The frequency, duration, pressure, duty cycle, and other variables of the pulses can be adjusted. For example, the variables can be adjusted during ramp up and ramp down, such as when changing from apparatus standby to steady state and back. The variables can also be adjusted between substrate sheets 112. As a further example, the variables can be adjusted based on the substrate type. For example, whether the substrate is rough paper or plastic. If rough paper the duty cycle can be higher if plastic the duty cycle can be less regardless of speed. Also, the throughput speed may be adjusted or both throughput speed and other variables may be adjusted. As an estimate, the duty cycle can be between 0.01 cycles per second and 1000 cycles per second. Separate fluid lines or a common fluid rail can be used to provide fluid to the spray nozzle 130. Pulsing of each of the plurality of spray nozzles may be synchronized or may not be synchronized. Also, the spray nozzles may or may not spray the leveler at different times or at the same time, which can result in different parts or the same part of the leveler being sprayed.

The release fluid 132 can be water with additives that are added to assist releasing the substrate 112 from the marking material leveler 122. The marking material leveling system 120 can level marking material 114 on the substrate 112 using the marking material leveler 122 with release fluid to produce leveled marking material 116 on the substrate 112.

The marking material leveling system 120 can include a donor roll 140. The at least one release fluid spray nozzle 130 can spray release fluid 132 onto the donor roll 140 and the donor roll 140 can transfer the release fluid 132 to the marking material leveler 122. The donor roll 140 can include a porous coating 142 that receives the release fluid 132 from the spray nozzle 130 and applies the release fluid 132 to the marking material leveler 122. For example, the porous coating 142 can be a fabric, a capillary material, or any other porous coating.

The apparatus 100 can include a controller 150 that can control release fluid 132 delivery from the spray nozzle 130 to the marking material leveler 122 by periodically pulsing the release fluid 132 spray. For example, the release fluid spray can be pulsed by periodically turning on and off the release fluid spray from the spray nozzle 130. Also, an amount of release fluid 132 sprayed from the spray nozzle 130 can be based on one of a print rate of the substrate 112, a throughput 170 rate of the substrate 112, a media type of the substrate 112, a percent of image coverage of marking material 114 on the substrate 112, and/or other relevant variables.

The spray nozzle 130 can spray release fluid 132 with a viscosity of less than 10 centipoise. For example, the spray nozzle can be specially designed to spray release fluid with a viscosity of less than 10 centipoise.

The apparatus 100 can include a sensor 152 and a user interface 154. The sensor 152 can sense release fluid carried out by the substrate 112. The user interface 154 can include a keypad, buttons, a touch pad, a joystick, an additional display, a touch screen display, or any other device useful for providing an interface between a user and an electronic device. The apparatus 100 can also include a fountain solution return 160 that can filter, reclaim, and/or discard release fluid 132.

Figure 2:
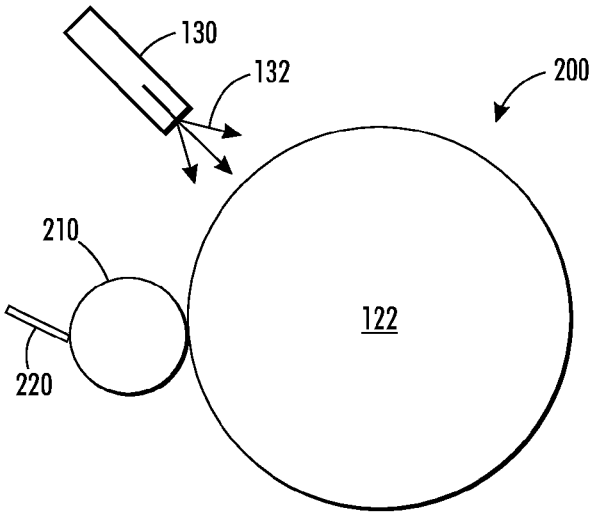
FIG. 2 is an example illustration of an apparatus according to one possible embodiment.

FIG. 2 is an example illustration of an apparatus 200 according to one possible embodiment. The apparatus 200 can include elements of the apparatus 100, such as the marking material leveler 122 and the at least one release fluid spray nozzle 130. The at least one release fluid spray nozzle 130 can spray release fluid 132 directly onto the marking material leveler 122. For example, the marking material leveler 122 can be a marking material leveling roll and the release fluid 132 can be sprayed directly onto the marking material leveling roll using the at least one release fluid spray nozzle 130. The apparatus 200 can also include a metering roll 210 coupled to the marking material leveler 122. The metering roll 210 can meter release fluid on the marking material leveler 122. For example, the metering roll 210 can contact the marking material leveler 122 and adjust, reduce, split, or otherwise meter release fluid on the marking material leveler 122. The apparatus 200 can include a blade 220 that can remove release fluid from the metering roll 210.

Figure 3:
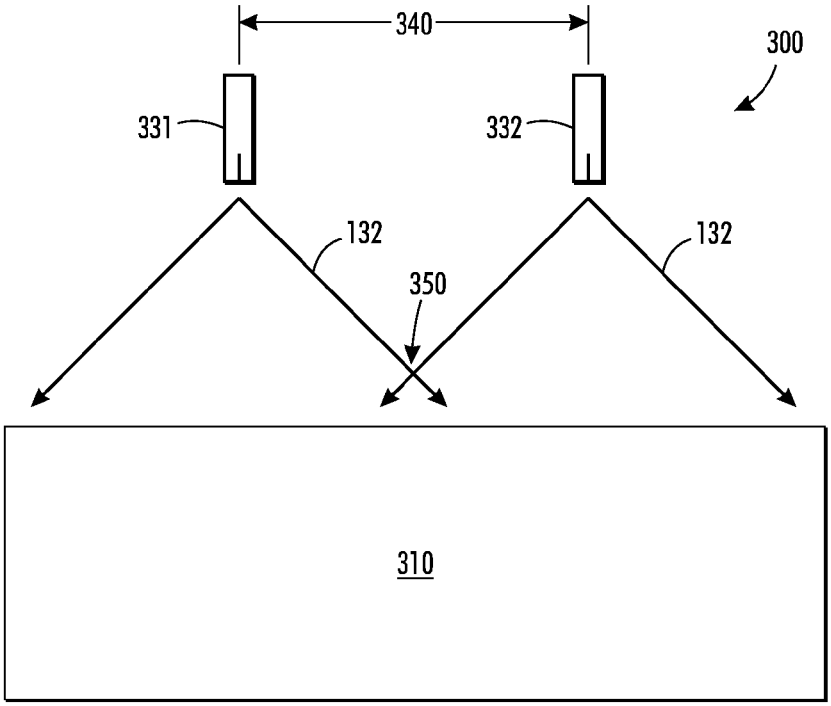
FIG. 3 is an example illustration of an apparatus according to one possible embodiment.

FIG. 3 is an example illustration of an apparatus 300 according to one embodiment with a view orthogonal to the view of FIG. 1. The apparatus 300 can include elements of the apparatus 100 and/or the apparatus 200. The apparatus 300 can include a marking material leveler 310, such as the marking material leveler 122. The apparatus 300 can further include a first spray nozzle 331 and a second spray nozzle 332, such as the spray nozzle 130. The apparatus 300 can also include additional spray nozzles. The spray nozzles 331 and 332 can spray release fluid 132 for the marking material leveler 310. The spray nozzles 331 and 332 can spray the release fluid 132 directly onto the marking material leveler 310 or can spray the release fluid 132 onto an intermediate element, such as a donor roll (not shown) and the release fluid 132 can be transferred to the marking material leveler 310.

The spray nozzles 331 and 332 can be spaced a distance from each other 340 depending on the desired spray from the spray nozzles 331 and 332. The sprayed release fluid 132 can overlap 350. Common electronics or different electronics can be used for each spray nozzle 331 and 332. The electronics can sense when one nozzle is in trouble has degraded performance or is otherwise not functioning correctly, using sensors or other feedback mechanisms coupled to the nozzle, and can adjust accordingly and/or set a flag or can make other adjustments.

Embodiments can provide for applying a thin layer of release fluid 132, such as fountain solution that can include water and additives, to a leveler roll surface, such as the marking material leveler 122 surface 134. A fine controlled spray nozzle, such as the spray nozzle 130, combined with an intermediate donor roll, such as the donor roll 140, can be used to apply the release fluid 132.

Embodiments can use a low volume spray nozzle 130 to accurately apply fountain solution to an intermediate donor roller 140 which in turn can apply a uniform layer onto a contact leveling roll surface 134. The donor roll 140 can include an elastomer with a fabric or similar porous coating 142. One reason for this can be that the spray 132 can be pulsed and such a coating can be used to make sure the fluid 132 is uniformly distributed about the donor roll 140. A layer 142 that has capillary action can accomplish this task.

According to one example, the thin, such as about 300 nm, fluid layer on a roller surface 134 can be specifically formulated to promote release of the ink-image 116 and substrate 112 from the roller 122 following a leveling nip. If fountain solution is not used, the ink 114 can stick to the roll surface 134 and either the ink layer 116 can split causing offset or the entire sheet 112, can adhere to the roll 122 causing a jam and potential service call.

Embodiments can use ultra low volume wide-flat spray nozzles that can be specifically designed and manufactured to apply a uniform spray pattern when properly spaced and pressurized. For example, two nozzles, when properly spaced from the donor roll and from each other, can administer a very uniform amount of fluid along the rotational axis of the donor roll 140. A soft-nip forming donor roll can absorb the fluid and split the fluid to the leveler roll 122. This concept was tested and was able to successfully release partially cured and contact leveled prints on substrates 112.

A multi-roll dampening system using a fluid sump can also apply release fluid to a leveler roll. However, multi-roll dampening system using a fluid sump cannot vary application rates of the release fluid mid-run. A spray nozzle 130 can pulse the application of the release fluid. The spray can be pulsed by stopping and starting the spray as function of print rate, media type or even percent image coverage, which can preserve the fluid and eliminate excess build up. Additionally, some release agent management systems start out with a large amount of fluid on the rolls, which can lead to the first few sheets having too much release agent and in some cases the first substrate sheets must be discarded. A spray nozzle 130 can help ensure that the release agent is only applied when needed and in the correct volumes.

Embodiments can also eliminate the open sump used with multi-roll damping systems because open sumps can spill if tipped and can it accumulate build of contaminants. In one embodiment, any excess fluid from the nozzle can drain into a tank 160 and the excess fluid can either be discarded or reused. The source of the fountain solution can be a premixed solution held in a reservoir or it can be directly connected to a water line with a controlled level of fountain solution being added to the stream 132.

A release fluid can be used for a contact leveling process. The leveling can be done at, or slightly above room temperature so as not to boil off any water in the release fluid. Testing has shown that changing the pulse parameters and the fluid line pressure can effectively tailor fluid delivery depending on factors such as distance of spray nozzle from rolls, desired amount of release fluid, release fluid carryout, distance of multiple spray nozzles from each other, throughput of substrates, and other relevant factors.

Embodiments can provide for a method utilizing spray nozzles to apply release fluid to a leveling roll for contact leveling of ultraviolet curable inks. Embodiments can also provide for pulsed operation of spray nozzles to control fluid delivery. Embodiments can also provide for a donor roll with capillary material to distribute fluid more evenly.

Figure 4:
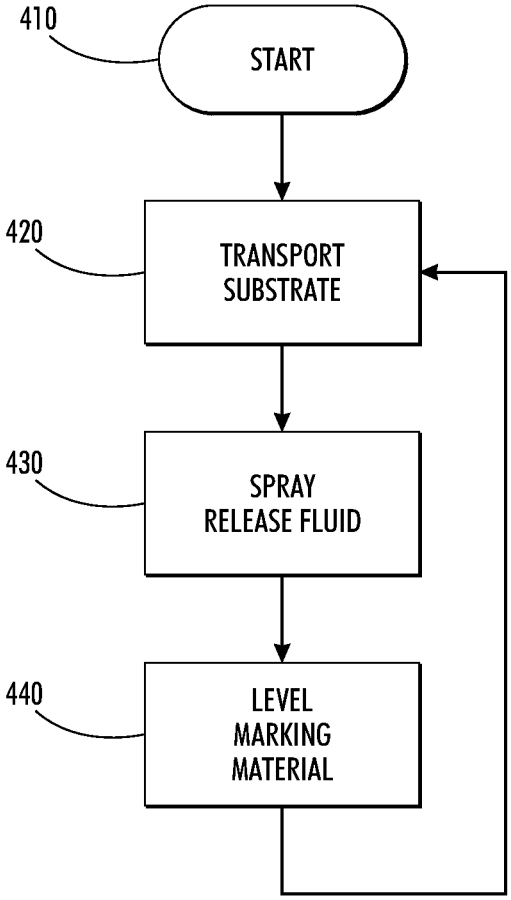
FIG. 4 illustrates an example flowchart of a method of applying release fluid to a leveler in a printing apparatus according to one possible embodiment.

FIG. 4 illustrates an example flowchart 400 of a method of applying release fluid to a leveler in a printing apparatus according to one possible embodiment. The printing apparatus can have a substrate path, at least one release fluid spray nozzle, and a marking material leveling system having a marking material leveler. The spray nozzle can be configured to spray release fluid with a viscosity of less than 10 centipoise. For example, the spray nozzle can be specially designed to spray release fluid with a viscosity of less than 10 centipoise.

The method can start at 410. At 420, a substrate with marking material can be transported along the substrate path. The marking material can be an ultraviolet curable ink.

At 430, release fluid can be pulse sprayed to the marking material leveling system using the at least one release fluid spray nozzle to apply the release fluid to the marking material leveler. For example, pulsing can be a series of intermittent occurrences including changes in quantity of release fluid. The release fluid can be water with additives that are added to assist releasing the substrate from the marking material leveler.

The marking material leveling system can include a donor roll. Release fluid can be pulse sprayed onto the donor roll using the at least one release fluid spray nozzle and the release fluid can be transferred from the donor roll to the marking material leveler. The donor roll can include a porous coating that receives the release fluid from the spray nozzle and applies the release fluid to the marking material leveler. For example, the porous coating can be a fabric, a capillary material, or any other porous coating.

The release fluid can also be pulse sprayed directly onto the marking material leveler using the at least one release fluid spray nozzle. The marking material leveler can be a marking material leveling roll and the release fluid can be pulse sprayed directly onto the marking material leveling roll using the at least one release fluid spray nozzle. The apparatus can include a metering roll coupled to the marking material leveler and release fluid on the marking material leveler can be metered using the metering roll. For example, the metering roll can contact a marking material leveling roll and can adjust, reduce, split, or otherwise meter release fluid on the marking material leveling roll.

Release fluid delivery from the spray nozzle to the marking material leveler can be controlled by periodically pulsing the release fluid spray. For example, the release fluid spray can be pulsed by periodically turning on and off the release fluid spray from the spray nozzle. An amount of release fluid sprayed from the spray nozzle can be based a print rate of the substrate, a throughput rate of the substrate, a media type of the substrate, a percent of image coverage of marking material on the substrate, or any other variable.

At 440, marking material can be leveled on the substrate using the marking material leveler with release fluid.

According to some embodiments, all of the blocks of the flowchart 400 are not always necessary. Additionally, the flowchart 400 or blocks of the flowchart 400 may be performed numerous times, such as iteratively. For example, the flowchart 400 may loop back from later blocks to earlier blocks. Furthermore, many of the blocks can be performed concurrently or in parallel processes.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in an apparatus including a substrate path, at least one release fluid spray nozzle, and a marking material leveling system having a marking material leveler, the method comprising:

transporting a substrate with marking material along the substrate path;

pulse spraying release fluid to the marking material leveling system using the at least one release fluid spray nozzle to apply the release fluid to the marking material leveler;

leveling marking material on the substrate using the marking material leveler with release fluid;

wherein pulse spraying comprises pulse spraying release fluid directly onto the marking material leveler using the at least one release fluid spray nozzle;

wherein the apparatus further comprises a metering roll coupled to the marking material leveler, and wherein the method further comprises metering release fluid on the marking material leveler using the metering roll.

2. The method according to claim 1, wherein the marking material leveling system includes a donor roll, wherein pulse spraying comprises pulse spraying release fluid onto the donor roll using the at least one release fluid spray nozzle, and wherein the method further comprises transferring the release fluid from the donor roll to the marking material leveler.

3. The method according to claim 2, wherein the donor roll includes a porous coating that receives the release fluid from the spray nozzle and applies the release fluid to the marking material leveler.

4. The method according to claim 1, further comprising controlling release fluid delivery from the spray nozzle to the marking material leveler by periodically pulsing the release fluid spray.

5. The method according to claim 1, wherein an amount of release fluid sprayed from the spray nozzle is based on one of a print rate of the substrate, a throughput rate of the substrate, a media type of the substrate, and a percent of image coverage of marking material on the substrate.

6. The method according to claim 1, wherein the marking material comprises a radiation curable ink.

7. The method according to claim 1, wherein the spray nozzle is configured to spray release fluid with a viscosity of less than 10 centipoise.

8. The method according to claim 1, wherein the release fluid comprises water with additives that are added to assist releasing the substrate from the marking material leveler.

9. An apparatus comprising:

a substrate path that transports a substrate with marking material on the substrate;

a marking material leveling system having a marking material leveler that levels marking material on the substrate; and at least one release fluid spray nozzle that sprays release fluid to the marking material leveling system to apply the release fluid to the marking material leveler, wherein the marking material leveling system levels marking material on the substrate using the marking material leveler with release fluid and the spray nozzle is configured to spray release fluid with a viscosity of less than 10 centipoise.

10. The apparatus according to claim 9, wherein the marking material leveling system includes a donor roll, and wherein the at least one release fluid spray nozzle sprays release fluid onto the donor roll and the donor roll transfers the release fluid to the marking material leveler.

11. The apparatus according to claim 10, wherein the donor roll includes a porous coating that receives the release fluid from the spray nozzle and applies the release fluid to the marking material leveler.

12. The apparatus according to claim 9, wherein the at least one release fluid spray nozzle sprays release fluid directly onto the marking material leveler.

13. The apparatus according to claim 12, further comprising a metering roll coupled to the marking material leveler, where the metering roll meters release fluid on the marking material leveler.

14. The apparatus according to claim 9, further comprising a controller configured to controlling release fluid delivery from the spray nozzle to the marking material leveler by periodically pulsing the release fluid spray.

15. A method in an apparatus including a substrate path, at least one release fluid spray nozzle, and an ultraviolet curable ink leveling system having a radiation curable ink leveler, the method comprising:

transporting a substrate with ultraviolet curable ink along the substrate path;

periodically spraying release fluid to the radiation curable ink leveling system using the at least one release fluid spray nozzle to uniformly distribute the release fluid on the radiation curable ink leveler; and leveling radiation curable ink on the substrate using the radiation curable ink leveler with release fluid, wherein the spray nozzle is configured to spray release fluid with a viscosity of less than 10 centipoise.

* * * * *